US008650991B2

(12) United States Patent
Lin

(10) Patent No.: US 8,650,991 B2
(45) Date of Patent: Feb. 18, 2014

(54) RATCHET WRENCH

(76) Inventor: Yi-Hung Lin, Taichung (TW)

( * ) Notice: Subject to any disclaimer, the term of this patent is extended or adjusted under 35 U.S.C. 154(b) by 328 days.

(21) Appl. No.: 13/097,138

(22) Filed: Apr. 29, 2011

(65) Prior Publication Data

US 2012/0272793 A1 Nov. 1, 2012

(51) Int. Cl.
*B25B 13/46* (2006.01)

(52) U.S. Cl.
USPC ..... 81/63.2; 81/60; 81/61; 81/62; 81/63

(58) Field of Classification Search
USPC ..... 81/60, 61, 62, 63, 63.2
See application file for complete search history.

(56) References Cited

U.S. PATENT DOCUMENTS 2,957,377 A * 10/1960 Hare ..... 81/63.2
4,703,676 A * 11/1987 Mayer ..... 81/63
5,119,701 A * 6/1992 Wei ..... 81/63
5,927,158 A * 7/1999 Lin ..... 81/60
6,070,502 A * 6/2000 Chang ..... 81/63

* cited by examiner

*Primary Examiner* — Lee D Wilson
*Assistant Examiner* — Shantese McDonald

(57) ABSTRACT

A ratchet wrench includes a handle; a wrench head comprising a first cavity and a second cavity communicating therewith; a drive gear and socket combination rotatably disposed in the first cavity and comprising surface teeth; a reversing pawl comprising pawl teeth on one surface, the pawl teeth meshed with the teeth of the drive gear and socket; a pivotal unit pivotably disposed in the second cavity, the pivotal unit urging against the other surface of the reversing pawl and being adapted to reciprocally pivot about the reversing pawl; and a reversing button assembly moveably disposed on the wrench hand and aligned with an axial direction of the handle. The reversing button assembly is adapted to manually move along a straight line to activate the pivotal unit which pivots the reversing pawl so as to permit the drive gear and socket combination to rotate clockwise or counterclockwise.

4 Claims, 7 Drawing Sheets

RATCHET WRENCH

BACKGROUND OF THE INVENTION

1. Field of the Invention

The invention relates to ratchet wrenches and more particularly to a ratchet wrench having an axially moveable reversing button for ease of switching between clockwise driving and counterclockwise driving of the ratchet head.

2. Description of Related Art

A conventional ratchet wrench 1 s shown in FIG. 8 and comprises a handle 2 and a reversing lever 3 capable of leftward or rightward pivoting to switch between clockwise driving and counterclockwise driving of the ratchet head.

However, there is a drawback of the conventional ratchet wrench 1. In detail, the reversing lever 3 is capable of only either leftward or rightward pivoting. For a user, it is not convenient in use since the finger has to perform a leftward or rightward pivoting operation in an awkward way. Thus, the need for improvement still exists.

SUMMARY OF THE INVENTION

It is therefore one object of the invention to provide a ratchet wrench comprising an elongated handle; a wrench head integrally formed with the handle and comprising a first cavity and a second cavity communicating therewith; a drive gear and socket combination rotatably disposed in the first cavity and comprising surface teeth; a reversing pawl comprising pawl teeth on one surface, the pawl teeth meshed with the teeth of the drive gear and socket; a pivotal unit pivotably disposed in the second cavity, the pivotal unit urging against the other surface of the reversing pawl and being adapted to reciprocally pivot about the reversing pawl; and a reversing button assembly moveably disposed on the wrench hand and aligned with an axial direction of the handle; wherein the reversing button assembly is adapted to manually move along a straight line to activate the pivotal unit which pivots the reversing pawl so as to permit the drive gear and socket combination to rotate clockwise or counterclockwise.

The above and other objects, features and advantages of the invention will become apparent from the following detailed description taken with the accompanying drawings.

DETAILED DESCRIPTION OF THE INVENTION

Figure 1:
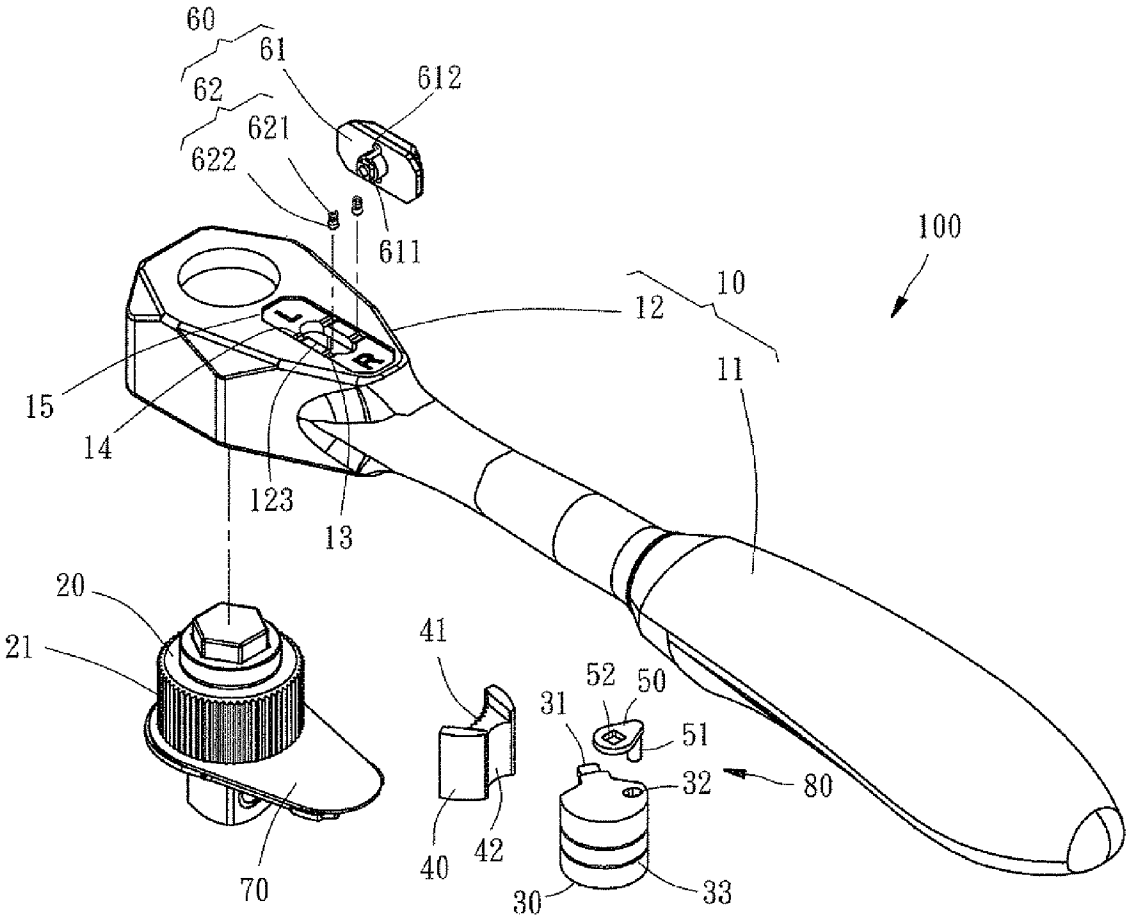
FIG. 1 is an exploded view of a ratchet wrench according to the invention.

Referring to FIGS. 1 to 7, a ratchet wrench 100 in accordance with the invention comprises a main body 10, a drive gear and socket combination 20, a pivotal unit 30, a reversing pawl 40, a follower member 50, and a reversing button assembly 60. Each component will be discussed in detail below.

The main body 10 comprises an elongated handle 11 to held by the hand, and a wrench head 12 integrally formed therewith. In the wrench head 12 there are provided a forward first cavity 121 and a rear second cavity 122 communicating therewith. An opening 123 is formed on top of the second cavity 122. An axial, elongated recess 15 is formed on top the wrench head 12 on the opening 123. A rear, interrupted first groove 13 and a forward, interrupted second groove 14 are formed on the recess 15. The first groove 13 and the second groove 14 are spaced by a distance.

The drive gear and socket combination 20 is rotatably provided in the first cavity 121 and comprises teeth 21 on its cylindrical surface. The pivotal unit 30 is pivotably provided in the second cavity 122 and comprises a projection 31 on a surface, a top blind hole 32 parallel to a pivot axis of the pivotal unit 30, and a plurality of (e.g., two) surface troughs 33. The reversing pawl 40 is disposed between the drive gear and socket combination 20 and the pivotal unit 30 and comprises pawl teeth 41 on one surface, the pawl teeth 41 meshed with the teeth 21, and a detent notch 42 on the other opposite surface engaged with the projection 31.

The follower member 50 comprises a downward peg 51 retained in the blind hole 32 and urging against an inner surface of the blind hole 32, and a square retaining hole 52 on top. The reversing button assembly 60 covers the opening 123 and is retained in the recess 15. The reversing button assembly 60 comprises a reversing button 61 including a bottom protrusion 611 of square cross-section, the protrusion 611 positioned in the square retaining hole 52, and two opposite wells 612 on both sides of the protrusion 611 respectively; and a detent mechanism 62 including two sets of a compression spring 621 and a steel ball 622 in which the steel ball 622 of one set is seated on one half portion of the first groove 13, the compression spring 621 of one set is disposed in one well 612 to have one end urging against bottom of the reversing button 61 and the other end urging the steel ball 622 of the same set against one half portion of the first groove 13; and the steel ball 622 of the other set is seated on the other half portion of the first groove 13, the compression spring 621 of the other set is disposed in the other well 612 to have one end urging against bottom of the reversing button 61 and the other end urging the steel ball 622 of the same set against the other half portion of the first groove 13. It is noted that letter "L" and letter "R" shown on, for example, FIG. 1 represent counterclockwise driving and clockwise driving of the ratchet wrench respectively.

Figure 2:
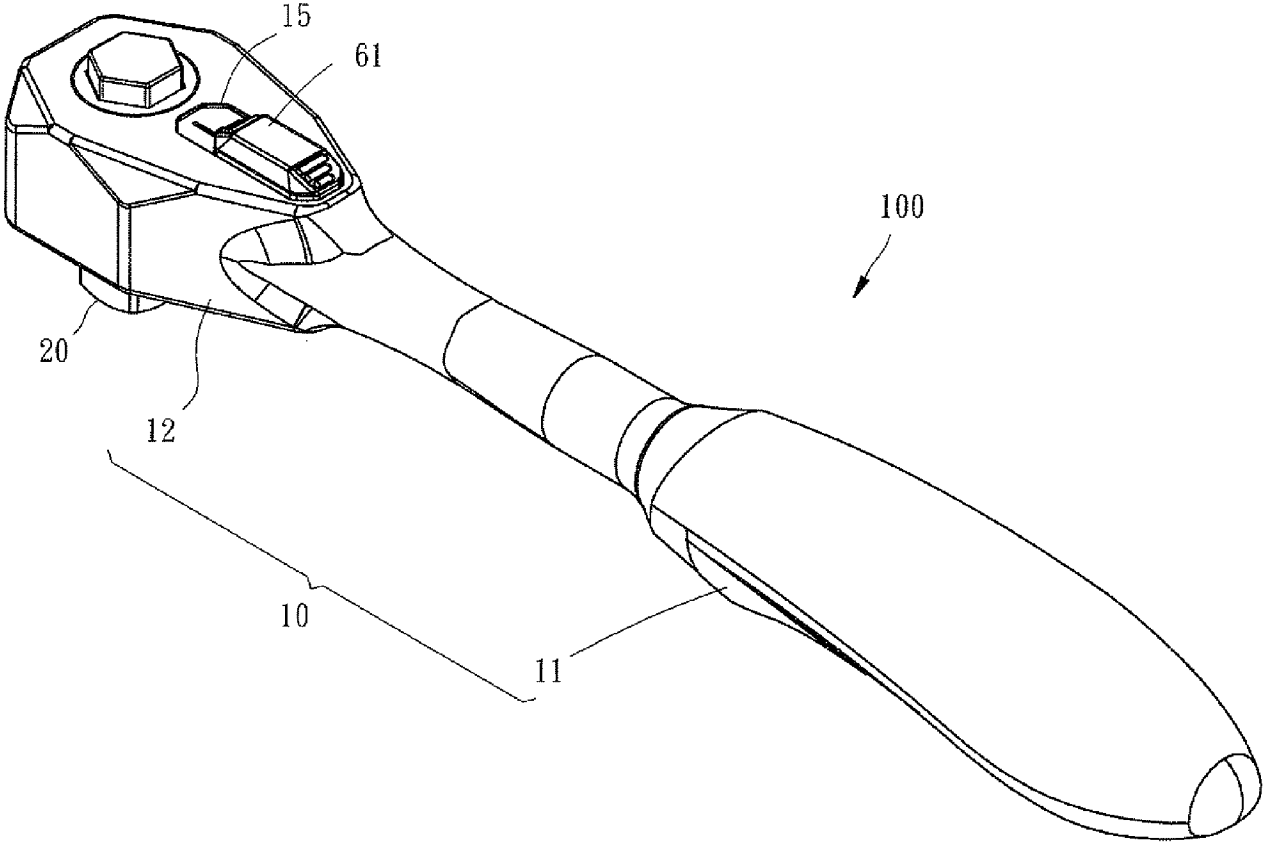
FIG. 2 is a perspective view of the assembled ratchet wrench showing the reversing button in a first switching position.
Figure 4:
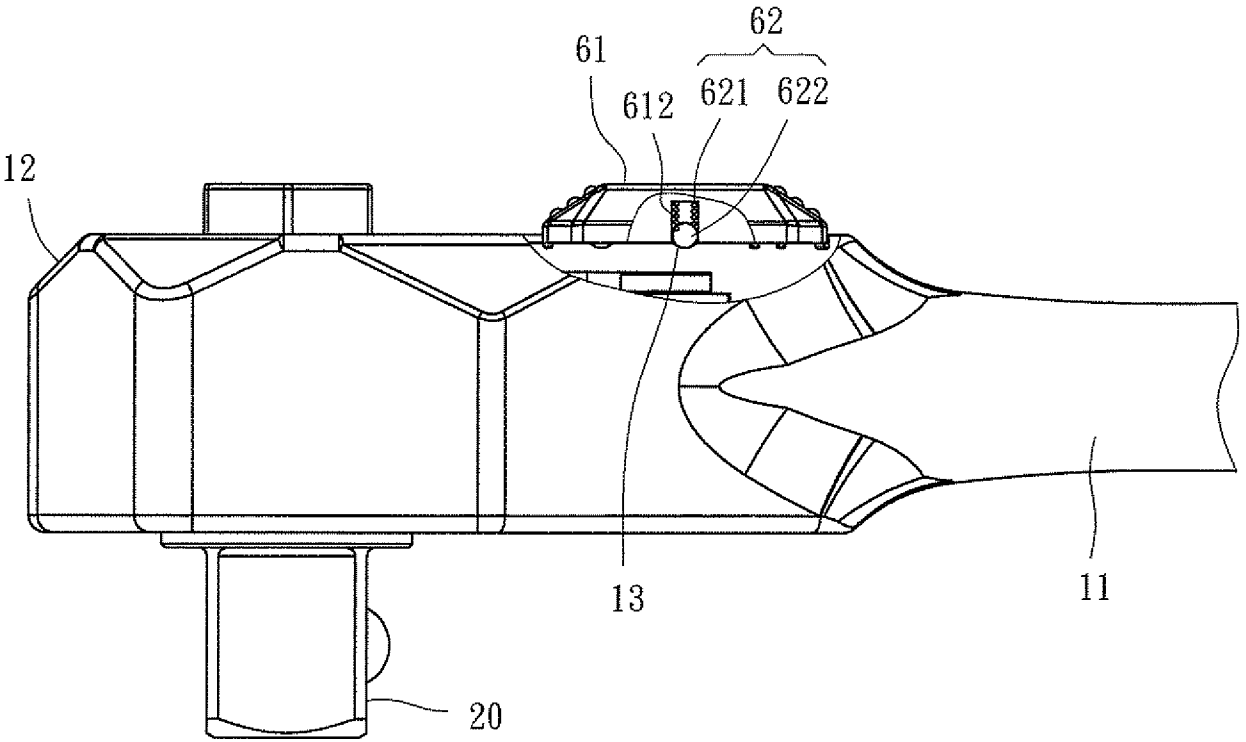
FIG. 4 is a fragmentary, enlarged view of the ratchet head of FIG. 2.
Figure 6:
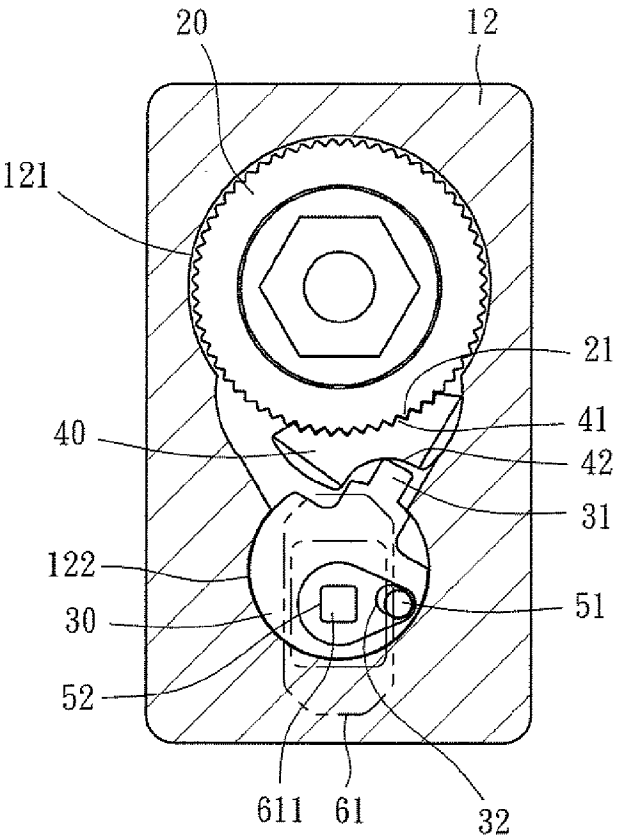
FIG. 6 is a cross-sectional view of the ratchet head of FIG. 4.
Figure 8:
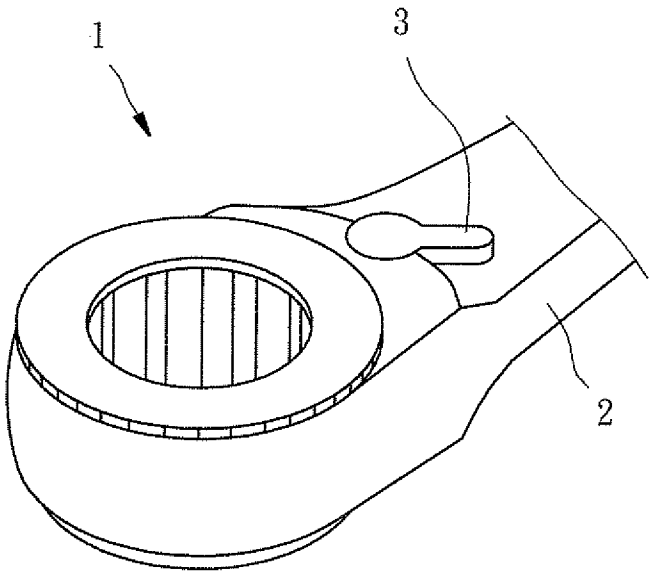
FIG. 8 is a perspective view of a ratchet head and a portion of a handle adjacent thereto of a typical ratchet wrench.

Operation of the invention will be described in detailed below. As shown in FIGS. 2, 4 and 6, in a predetermined position (i.e., the first switching position) the reversing button 61 is disposed on a rear portion of the recess 15 with the letter "L" exposed, the steel balls 622 are urged against the first groove 13 by the compression springs 621, the projection 31 urging against the detent notch 42, the reversing pawl 40 is stopped by one wall of a joining portion of the first cavity 121 and the second cavity 122, and the drive gear and socket combination 20 is permitted to rotate counterclockwise only.

Figure 3:
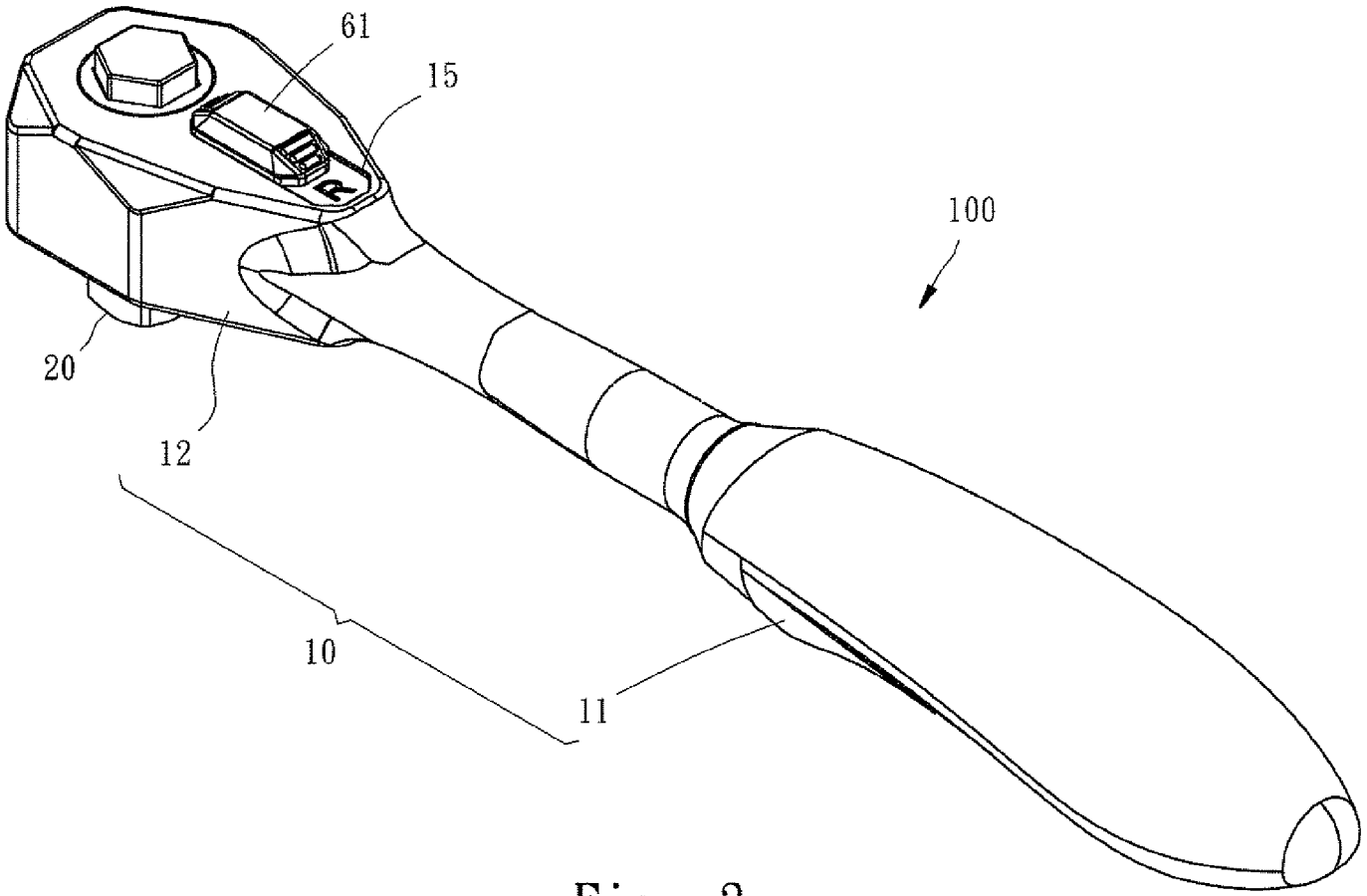
FIG. 3 is a view similar to FIG. 2 showing the reversing button in a second switching position.
Figure 5:
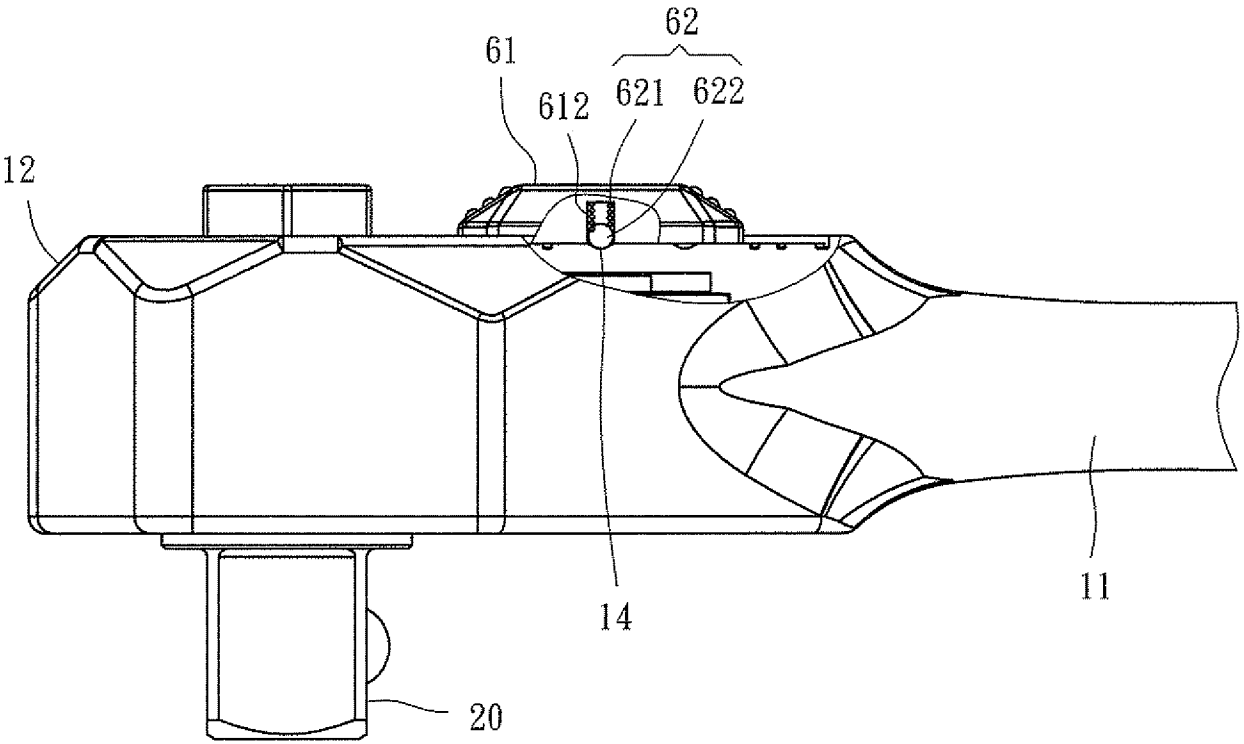
FIG. 5 is a fragmentary, enlarged view of the ratchet head of FIG. 3.
Figure 7:
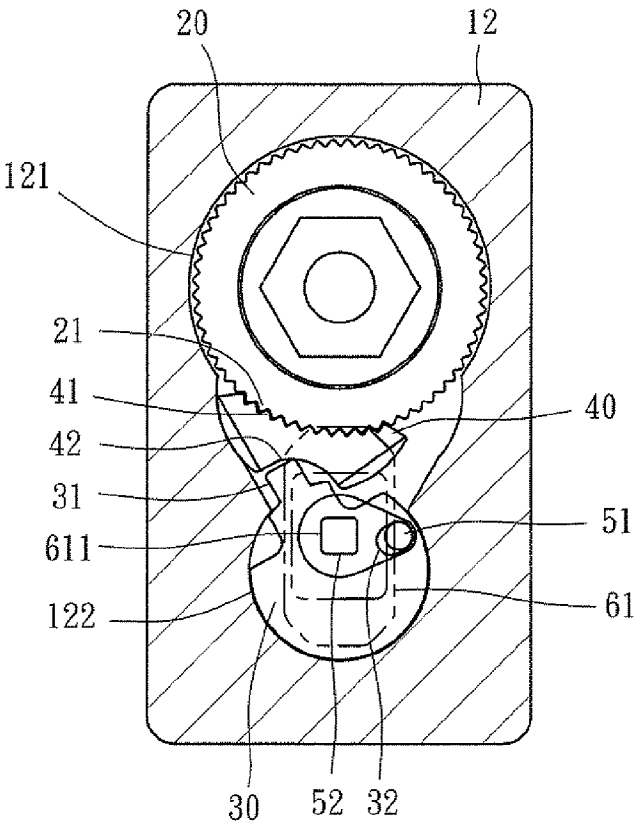
FIG. 7 is a cross-sectional view of the ratchet head of FIG. 5.

As shown in FIGS. 3, 5 and 7, in response to a manual movement (i.e., moving in a direction the same as the lengthwise axis of the handle 11) of the reversing button 61 from the first switching position to the second switching position by the finger, the reversing button 61 is disposed on a forward portion of the recess 15 with the letter "R" exposed, the steel balls 622 are moved from the first groove 14 to the second groove 14 and urged against the second groove 14 by the compression springs 621, the pivotal unit 30 is pushed by the protrusion 611 to pivot both the projection 31 and the reversing pawl 40 counterclockwise until the reversing pawl 40 is stopped by the other wall of the joining portion of the first cavity 121 and the second cavity 122 (i.e., from the position shown in FIG. 6 to that shown in FIG. 7), and the drive gear and socket combination 20 is permitted to rotate clockwise only.

It is envisaged by the invention that a simple pushing of the push button along the lengthwise direction of the handle can either clockwise drive or counterclockwise drive of the ratchet head. Thus, it is convenient in use.

Preferably, the blind hole 32 has an oval cross-section. Further, the troughs 33 may be filled with lubricant for reducing friction, improving efficiency, and reducing wear.

A cover plate 70 may be additionally provided on the bottom of the wrench head 12 to conceal the first cavity 121 and the second cavity 122. Thus, only the bottom socket of the drive gear and socket combination 20 is exposed. Further, the blind hole 32, the follower member 50, and the peg 51 can be viewed as three components of a cam mechanism 80.

While the invention has been described in terms of preferred embodiments, those skilled in the art will recognize that the invention can be practiced with modifications within the spirit and scope of the appended claims.

What is claimed is:

1. A ratchet wrench comprising:

an elongated handle;

a wrench head integrally formed with the handle and comprising a first cavity and a second cavity communicating therewith;

a drive gear and socket combination rotatable disposed in the first cavity and comprising surface teeth;

a reversing pawl comprising pawl teeth on one surface, the pawl teeth meshed with the teeth of the drive gear and socket;

a pivotal unit pivotably disposed in the second cavity, the pivotal unit urging against the other surface of the reversing pawl and being adapted to reciprocally pivot about the reversing pawl;

a reversing button assembly moveably disposed on the wrench head and aligned with an axial direction of the handle; and a cam mechanism disposed between the reversing button assembly and the pivotal unit and comprising a blind hole in the pivotal unit;

wherein the reversing button assembly is adapted to manually move along a straight line to activate the pivotal unit which pivots the reversing pawl so as to permit the drive gear and socket combination to rotate clockwise or counterclockwise;

wherein the blind hole is parallel to a pivot axis of the pivotal unit and adapted to retain the reversing button assembly so that the movement of the reversing button assembly activates the cam mechanism to activate the pivotal unit which pivots the reversing pawl so as to permit the drive gear and socket combination to rotate clockwise or counterclockwise; and wherein the cam mechanism further comprises a follower member including a downward peg retained in the blind hole and urging against an inner surface of the blind hole so that the movement of the reversing button assembly activates the cam mechanism to activate the pivotal unit which pivots the reversing pawl so as to permit the drive gear and socket combination to rotate clockwise or counterclockwise.

2. The ratchet wrench of claim 1, wherein the follower member further comprises a top retaining hole, and wherein the reversing button assembly comprises a bottom protrusion complimentarily disposed in the retaining hole so that the movement of the reversing button assembly activates the cam mechanism to activate the pivotal unit which pivots the reversing pawl so as to permit the drive gear and socket combination to rotate clockwise or counterclockwise.

3. The ratchet wrench of claim 1, wherein the wrench head further comprises an axial, elongated top recess, a rear, interrupted first groove on the recess, and a forward, interrupted second groove on the recess, the second groove being spaced from the first groove; wherein the reversing button assembly is retained in the recess and comprises a spring depressible detent mechanism positioned between the reversing button assembly and the recess; and wherein the detent mechanism is located at the first groove when the reversing button assembly is at a rear first switching position, and the detent mechanism is located at the second groove when the reversing button assembly is at a forward second switching position.

4. The ratchet wrench of claim 3, wherein the reversing button assembly comprises a reversing button and a bottom protrusion having two side wells; wherein the detent mechanism comprises two sets of a compression spring and a steel ball; wherein the steel ball of one set is seated on one half portion of the first groove, the compression spring of one set is disposed in one well to have one end urging against bottom of the reversing button and the other end urging the steel ball of the same set against one half portion of the first groove, and the steel ball of the other set is seated on the other half portion of the first groove, the compression spring of the other set is disposed in the other well to have one end urging against bottom of the reversing button and the other end urging the steel ball of the same set against the other half portion of the first groove; and wherein the steel balls are located at the first groove when the reversing button assembly is at the rear first switching position, and the steel balls are located at the second groove when the reversing button assembly is at the forward second switching position.

* * * * *